US008039775B2

(12) United States Patent
Venezia et al.

(10) Patent No.: US 8,039,775 B2
(45) Date of Patent: Oct. 18, 2011

(54) BUILT-IN OVEN WITH AN IMPROVED COOLING SYSTEM

(75) Inventors: Michele Venezia, Taino (IT); Marco Giuliani, Travedona Monate (IT); Cristina Mazzetti, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 211 days.

(21) Appl. No.: 12/419,346

(22) Filed: Apr. 7, 2009

(65) Prior Publication Data

US 2009/0255919 A1 Oct. 15, 2009

(30) Foreign Application Priority Data

Apr. 10, 2008 (EP) ..... 08103471

(51) Int. Cl.

| | |
|---|---|
| ***A21B 3/00*** | (2006.01) |
| ***A21B 3/02*** | (2006.01) |
| ***F24C 15/02*** | (2006.01) |
| ***F24C 15/32*** | (2006.01) |

(52) U.S. Cl. ..... 219/399; 219/391; 126/193; 126/198

(58) Field of Classification Search ..... None
See application file for complete search history.

(56) References Cited

U.S. PATENT DOCUMENTS

| | | | | |
|---|---|---|---|---|
| 3,587,557 | A * | 6/1971 | Henderson et al. | 26/21 A |
| 3,882,843 | A * | 5/1975 | Barnett | 126/273 A |
| 3,911,893 | A | 10/1975 | Baker et al. | |
| 4,331,124 | A * | 5/1982 | Seidel et al. | 126/21 A |
| 4,354,084 | A * | 10/1982 | Husslein et al. | 219/757 |
| 4,601,279 | A * | 7/1986 | Guerin | 126/21 A |
| 4,865,010 | A | 9/1989 | Kett | |
| 5,387,258 | A * | 2/1995 | Puricelli | 126/21 A |
| 5,918,589 | A | 7/1999 | Valle et al. | |
| 6,904,904 | B2 * | 6/2005 | Walther et al. | 126/198 |
| 7,708,007 | B2 * | 5/2010 | Kim et al. | 126/198 |

FOREIGN PATENT DOCUMENTS

| | | |
|---|---|---|
| EP | 1972855 | 9/2008 |
| WO | WO 2006/064457 | 6/2006 |

* cited by examiner

*Primary Examiner* — Joseph M Pelham
(74) *Attorney, Agent, or Firm* — Tara M. Hartman; Diederiks & Whitelaw, PLC

(57) ABSTRACT

A built-in oven has a door, a control panel positioned above the door and a cooling system including a fan-motor assembly for drawing cooling air around the outside surface of the oven and an exhaust duct for discharging air to the ambient. The cooling system comprises a cooling air supply duct above the top side of the oven and with an intake opening below the control panel, and an exhaust duct positioned above the supply duct so that its exhaust opening is placed above the control panel, the fan-motor assembly being mounted between the supply duct and the exhaust duct.

15 Claims, 2 Drawing Sheets

BUILT-IN OVEN WITH AN IMPROVED COOLING SYSTEM

BACKGROUND OF THE INVENTION

1. Field of the Invention

The present invention relates to a domestic built-in oven having a door, a control panel positioned above the door and a cooling system including a fan-motor assembly for drawing air around at least a portion of the oven and an exhaust duct for discharging air to the ambient. More specifically the invention is related to the inlet-outlet areas of the ventilation system and the flow path of the air inside the appliance.

2. Description of the Related Art

A built-in oven having an air outlet positioned above the control panel is shown by U.S. Pat. No. 4,865,010. This oven is a gas oven where the problems of vapor condensation on the control panel are quite relevant. Moreover such document discloses also a horizontal cool air duct which has an exhaust opening at the front of the oven, below the control panel and above the door. Even if the air discharged by such cool air duct does not contain the moisture contained in the gas flow discharged trough the upper outlet, nevertheless such air contains moisture too since it can draws air around the oven. Moreover, in order to reduce the temperature of the hot gases exhausted by the oven, an auxiliary cooling air duct is needed with a related exhaust opening in the area above the control panel for mixing the cooling air with the hot exhaust air. This construction is therefore quite complex and expensive.

The present electric built-in ovens do not have the problems of discharging the quite high flow rate of humid gas of a gas oven and they have the air outlet of the ventilation system below the control panel. Despite the lower content of moisture of the discharge air compared to gas oven, nevertheless this is known to create condensation issue as well, particularly while cooking food with high water content at low temperature cooking cycles or when specific environmental conditions are met. As a matter of fact in the ventilation system are exhausted the gases produced during the cooking process in the oven cavity, such gases being composed mostly of water vapor.

This humidity while escaping is going upwards due to the high temperature of the air and usually condenses on the outer cold oven surfaces, in particular on the control panel which is made of metal or glass and is provided with knobs, buttons, metal trim or aesthetical components. This is creating potential rust spots, scale build up and, and hot spots for customer. Moreover the condensation of humidity on electronic components behind the control panel, reached through possible apertures in the panel itself, can create potential risk of malfunction of electronic components of the oven.

The solution of the above US document cannot be easily transferred to an electric built-in oven since it was designed for gas ovens. Moreover its complexity, cost and the presence of a flow of discharge air below the control panel cannot solve the above mentioned problem of condensation in an electric oven.

SUMMARY OF THE INVENTION

An object of the present invention is to provide a built-in oven which does not present the above drawbacks and in which the humidity coming out from the cavity does not condensate on the control panel. Another object is to provide an oven in which the cooling system is simplified and in which the cooling system works effectively as an additional insulation wall for the oven and for the control panel as well.

According to the invention, such object is reached thanks to the features specified in the appended claims.

The technical solution according to the present invention is an innovative air flow system in which the air exhaust area is substantially above the control panel and in which the inlet area of the cooling air is substantially below the control panel. Any steam or water vapor produced inside the oven cavity, captured by the ventilation system and exiting this area is not impacting the control panel, knobs, and buttons or handles, thus dramatically reducing the condensation issue.

In order to allow a streamlined and efficient circulation of the cooling air, a double air channel, upwardly and downwardly a fan, is provided on the top of the oven structure.

BRIEF DESCRIPTION OF THE DRAWINGS

Further features and advantages of a built-in oven according to the invention will be clear from the following detailed description, provided by way of example, with reference to the attached drawings in which.

DETAILED DESCRIPTION OF THE PREFERRED EMBODIMENTS

Figure 1:
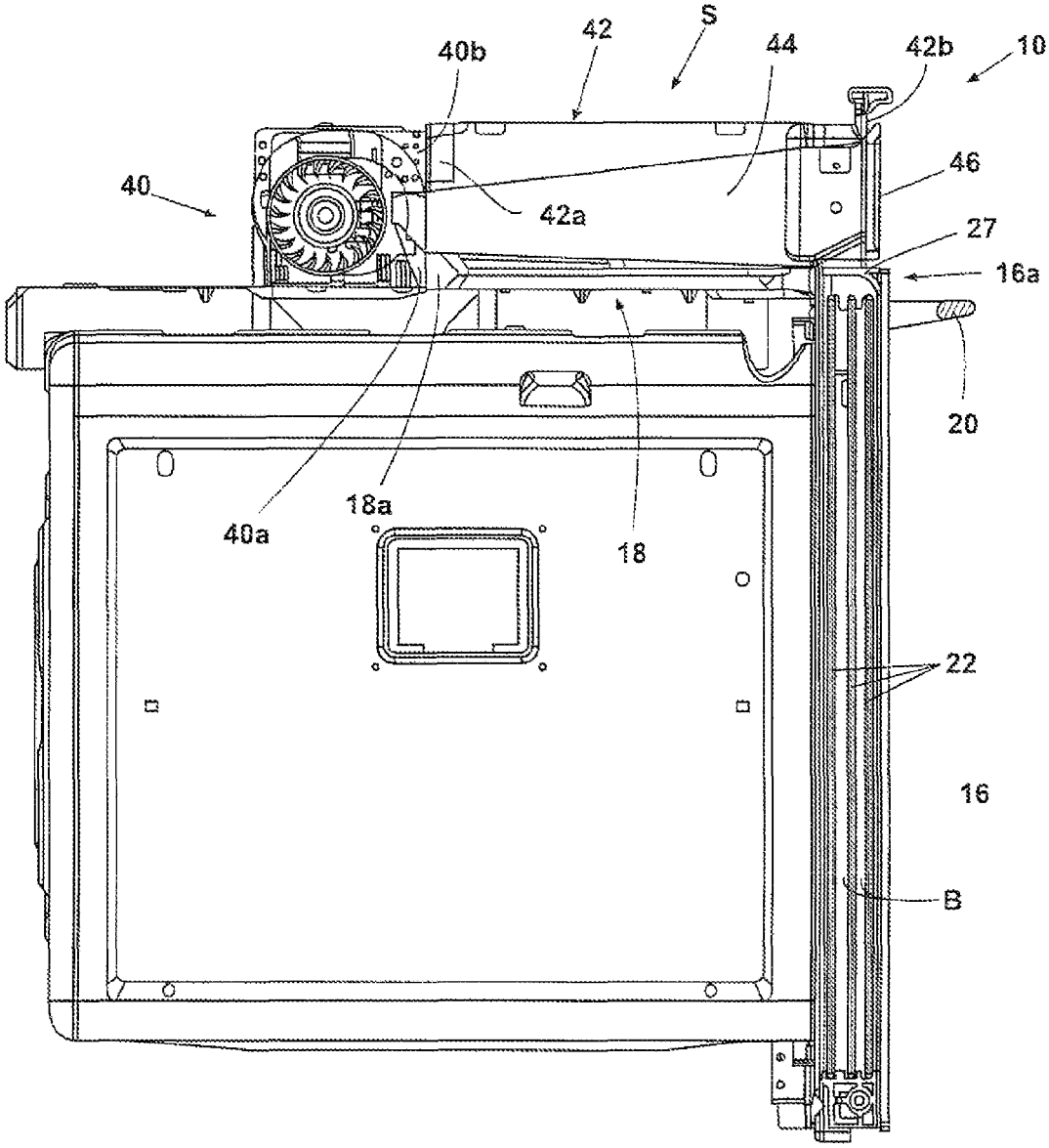
FIG. 1 is a vertical cross section of an oven according to the invention.

With reference to the drawings, a built-in oven 10 is shown having a cavity 12 defined by a metal thermally insulated structure 14 closed by a door 16. On top of the metal structure 14 there is defined an air ventilation system having a first lower cooling duct 18, having open ends 18*a* and 18*b*, to which is conveyed air around the metal structure of the oven and fresh air A coming from the outside of the oven in the region of an upper edge 16*a* of the door where a handle 20 is fixed to the door. A certain amount of the air around the metal structure 14 may be conveyed in a known manner through the glass plates 22 of the door 16, in order to cool it. In the embodiment shown in the drawings, the major portion of the cooling air is drawn through an interspace B between the glass plates 22 of the door 16. A deflector 27 is fixed to the upper edge of the door 16 in order to deflect the air flow and to deliver it, through apertures 29, towards an intake opening 31 adjacent end 18*b* of the lower cooling duct 18.

The lower cooling duct 18 has a generally rectangular shape with a width slightly less than the overall width of the oven, and it can be obtained by means of shaped metal foils assembled together or may be made of a single component of polymeric material.

Figure 2:
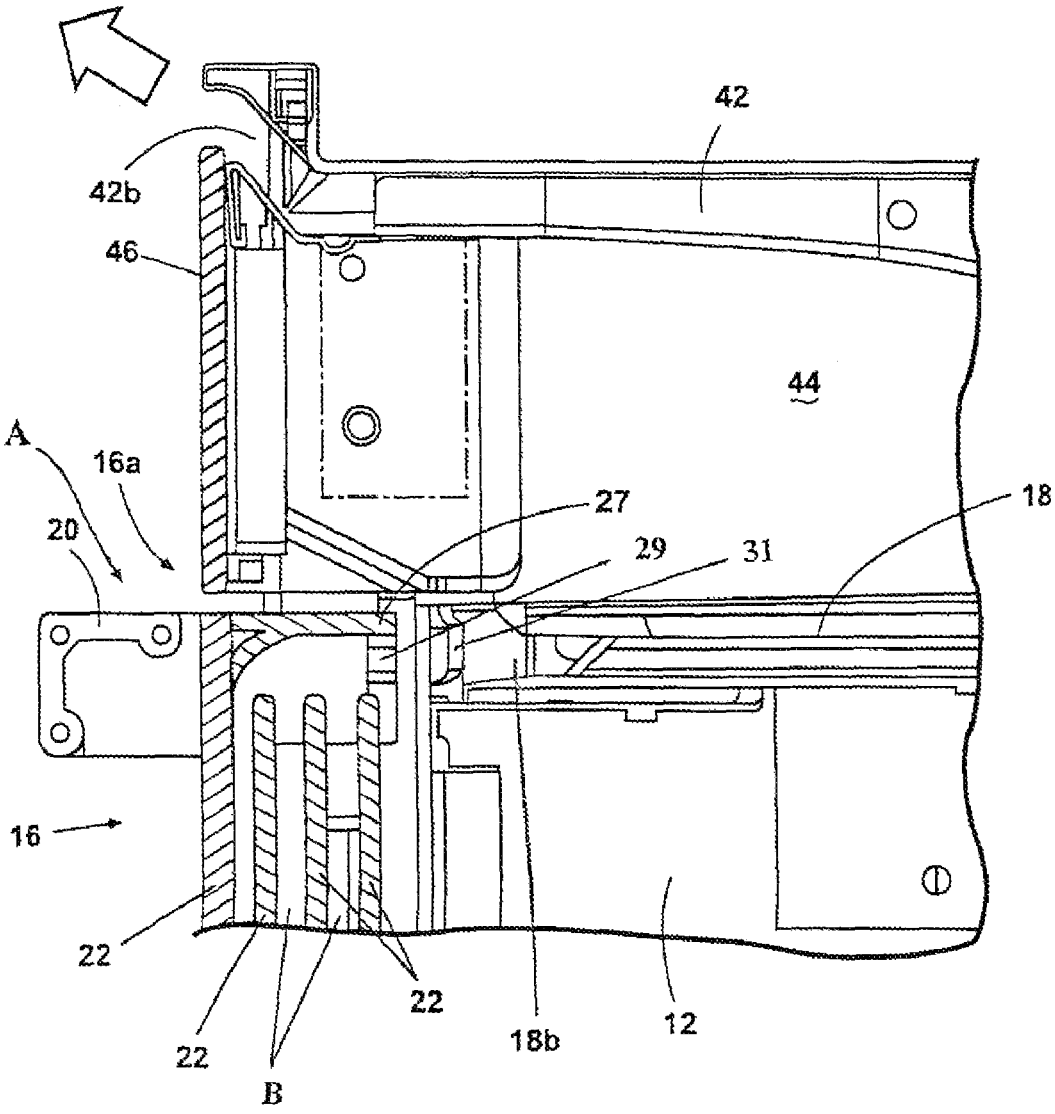
FIG. 2 is a detail of FIG. 1.

On the top wall of the oven a fan-motor assembly 40 is mounted, which is connected on its suction side 40*a* to an end 18*a* of the cooling duct 18. On top of the cooling duct 18, a discharge duct 42 is mounted, having a first end 42*a* connected to a delivery side 40*b* of fan-motor assembly 40. Also the discharge duct 42 has a generally rectangular shape and is detached from the cooling duct 18 so that to define a chamber 44 behind a control panel 46 of the oven. A second end 42*b* of the discharge duct is positioned above the control panel 46. Such second end 42*b* (FIG. 2) has an inclined discharge direction in order to further reduce any possibility of vapor condensation on the control panel 46.

In order to increase the air flow efficiency of the cooling system, the cooling duct 18 has a cross section area which is increasing towards its end 18*a*, while the discharge duct 42 has a cross section area which is decreasing towards its end 42*b*. It is clear from the above description how the use of a double channel on the top of the oven makes simple and efficient the cooling system of the oven, eliminating also the problem of water vapor condensation on the control panel, and reducing the temperature of the control panel as well.

We claim:

1. A built-in oven including a cooling system comprising:

an oven cavity;

a door movable mounted for selectively closing the oven cavity;

a control panel arranged above the door;

an intake opening provided below the control panel;

a fan-motor assembly including a suction side and a delivery side;

a lower cooling duct disposed above the oven cavity, said lower cooling duct having a first end open to the intake opening and a second end in fluid communication with the suction side of the fan-motor assembly, the lower cooling duct including a cross-sectional area that increases from the first end to the second end; and an upper discharge duct having a first end directly exposed to the delivery side of the fan-motor assembly and a second end leading to a discharge opening exposed above the control panel, the upper discharge duct including a cross-sectional area that decreases from the first end to the second end wherein, in use, the fan-motor assembly draws cool air into the intake opening, through the lower cooling duct, through the fan-motor assembly, through the upper discharge duct and exhausts the air above the control panel through the discharge opening.

2. The built-in oven according to claim 1, wherein the door is vertically spaced from the control panel such that fresh air is drawn into the intake opening from below the control panel.

3. The built-in oven according to claim 2, wherein the door includes at least two glass plates defining at least one air flow passage there between, wherein additional cooling air is directed through the at least one air flow passage and merged with fresh air drawn in below the control panel prior to entering the lower cooling duct.

4. The built-in oven according to claim 3, further comprising: an air deflector provided in the door, said air deflector being curved for redirecting the additional cooling air from the at least one air flow passage toward the lower cooling duct.

5. The built-in oven according to claim 4, further comprising: at least one aperture provided on the door for directing the additional cooling air, subsequent to being redirected by the air deflector, toward the lower cooling duct.

6. The built-in oven according to claim 5, wherein the at least one aperture is provided in the deflector so as to move with the door.

7. The built-in oven according to claim 5, wherein the intake opening is located above the oven cavity and behind the at least one aperture.

8. The built-in oven according to claim 2, wherein the intake opening is located behind the door.

9. The built-in oven according to claim 1, further comprising: a chamber arranged behind the control panel and tapering from behind the control panel toward the fan-motor assembly, said upper discharge duct being spaced from said lower cooling duct by said chamber.

10. The built-in oven according to claim 9, wherein each of the lower cooling duct and the upper discharge duct has a generally rectangular shape.

11. The built-in oven according to claim 1, wherein the discharge opening is inclined such that exhausted air is angled upwardly away from the control panel.

12. The built-in oven according to claim 1, wherein the upper discharge duct continuously decreases from the first end to the second end.

13. The built-in oven according to claim 12, wherein the lower cooling duct continuously increases from the first end to the second end.

14. The built-in oven according to claim 1, wherein the upper discharge duct only receives forced airflow from the fan-motor assembly and exhaust all of the forced airflow through the second end of the upper discharge duct.

15. The built-in oven according to claim 1, wherein the built-in oven is an electric oven.

* * * * *